US010612752B2

(12) United States Patent
Stolte et al.

(10) Patent No.: US 10,612,752 B2
(45) Date of Patent: Apr. 7, 2020

(54) DOWNWARDLY DIRECTING SPATIAL LIGHTING SYSTEM

(71) Applicant: KENALL MANUFACTURING COMPANY, Kenosha, WI (US)

(72) Inventors: Brandon Stolte, Lindenhurst, IL (US); Yanwai Mui, Skokie, IL (US)

(73) Assignee: KENALL MANUFACTURING COMPANY, Kenosha, WI (US)

( * ) Notice: Subject to any disclaimer, the term of this patent is extended or adjusted under 35 U.S.C. 154(b) by 0 days.

(21) Appl. No.: 15/922,316

(22) Filed: Mar. 15, 2018

(65) Prior Publication Data

US 2018/0202630 A1 Jul. 19, 2018

Related U.S. Application Data

(63) Continuation of application No. 14/215,853, filed on Mar. 17, 2014, now Pat. No. 10,030,852.

(Continued)

(51) Int. Cl.
*F21V 13/04* (2006.01)
*F21S 8/08* (2006.01)

(Continued)

(52) U.S. Cl.
CPC ..... *F21V 13/04* (2013.01); *F21S 8/086* (2013.01); *F21V 5/007* (2013.01); *F21V 5/08* (2013.01);

(Continued)

(58) Field of Classification Search
CPC ..... F21V 5/008; F21V 5/046; F21V 5/007; F21V 5/08; F21V 13/04; F21V 3/00; F21W 2131/103; F21S 8/086; F21K 9/00; F21K 9/54; G02F 1/133603; G02F 1/133605; G02F 1/133606; G02B 6/0011;

(Continued)

(56) References Cited

U.S. PATENT DOCUMENTS 5,803,579 A * 9/1998 Tumbull ..... B60L 1/14 362/516
6,948,838 B2 9/2005 Kunstler (Continued)

OTHER PUBLICATIONS

Non-Final Office Action, U.S. Appl. No. 13/310,983, dated Apr. 10, 2015.

*Primary Examiner* — Erin Kryukova
(74) *Attorney, Agent, or Firm* — Marshall, Gerstein & Borun LLP; Randall G. Rueth

(57) ABSTRACT

A luminaire that includes a plurality of light emitting diodes (LEDs), a light diffuser having a planar surface facing the LEDs, and a reflector that surrounds a cavity formed between the light diffuser and the LEDs. Also disclosed is a method of distributing light that involves emitting light towards a light diffuser having a planar surface having a reflective coating, scattering a first portion of the light with the light diffuser, reflecting a second portion of the light with the light diffuser, reflecting the second portion of the light with a first reflective surface back towards the light diffuser, and scattering the second portion of the light with the light diffuser. Further disclosed is another method of distributing light that involves emitting light toward a light diffuser and reflecting a portion of the emitted light toward the light diffuser via a reflector.

17 Claims, 4 Drawing Sheets

Related U.S. Application Data

(60) Provisional application No. 61/798,411, filed on Mar. 15, 2013.

(51) Int. Cl.

| | |
|---|---|
| ***F21V 5/00*** | (2018.01) |
| ***F21V 5/08*** | (2006.01) |
| ***F21V 3/00*** | (2015.01) |
| ***F21W 131/103*** | (2006.01) |
| ***F21Y 105/10*** | (2016.01) |
| ***F21Y 115/10*** | (2016.01) |

(52) U.S. Cl.
CPC ..... *F21V 3/00* (2013.01); *F21W 2131/103* (2013.01); *F21Y 2105/10* (2016.08); *F21Y 2115/10* (2016.08)

(58) Field of Classification Search
CPC .. G02B 6/0068; G02B 6/0073; G02B 6/0096; F21Y 2115/10; F21Y 2105/10
See application file for complete search history.

(56) References Cited

U.S. PATENT DOCUMENTS

| | | | | |
|---|---|---|---|---|
| 6,953,264 | B2 | 10/2005 | Ter-Hovhannisian | |
| 7,093,955 | B2 | 8/2006 | Sejkora et al. | |
| 7,828,465 | B2 | 11/2010 | Roberge et al. | |
| 8,226,273 | B2 | 7/2012 | Lai | |
| 8,272,765 | B2 | 9/2012 | Ter-Hovhannisyan | |
| 8,430,528 | B2 | 4/2013 | Yu et al. | |
| 9,297,521 | B2 | 3/2016 | Zhou | |
| 9,366,409 | B2 | 6/2016 | Holland et al. | |
| 2002/0097354 | A1 | 7/2002 | Greiner | |
| 2003/0053310 | A1 | 3/2003 | Sommers | |
| 2005/0225988 | A1 | 10/2005 | Chaves et al. | |
| 2006/0092662 | A1* | 5/2006 | Noh | G02F 1/133603 362/607 |
| 2006/0256255 | A1* | 11/2006 | Minami | G02B 6/0021 349/65 |
| 2008/0101063 | A1 | 5/2008 | Koike et al. | |
| 2008/0225512 | A1* | 9/2008 | Roberts | G02F 1/133603 362/97.1 |
| 2008/0273324 | A1 | 11/2008 | Becker et al. | |
| 2008/0310155 | A1* | 12/2008 | Huang | F21S 10/02 362/231 |
| 2009/0166653 | A1 | 7/2009 | Weaver, Jr. et al. | |
| 2009/0296403 | A1 | 12/2009 | Zhang et al. | |
| 2009/0310356 | A1* | 12/2009 | Laporte | F21V 5/007 362/239 |
| 2010/0091487 | A1 | 4/2010 | Shin | |
| 2010/0208473 | A1 | 8/2010 | Sakai et al. | |
| 2011/0002120 | A1 | 1/2011 | Song et al. | |
| 2011/0007505 | A1 | 1/2011 | Wang | |
| 2011/0013397 | A1 | 1/2011 | Catone et al. | |
| 2011/0026253 | A1 | 2/2011 | Gill | |
| 2011/0038151 | A1* | 2/2011 | Carraher | F21S 8/08 362/242 |
| 2011/0068708 | A1 | 3/2011 | Coplin et al. | |
| 2011/0110079 | A1* | 5/2011 | Jong | F21V 3/02 362/231 |
| 2011/0133622 | A1 | 6/2011 | Mo et al. | |
| 2011/0194282 | A1 | 8/2011 | Paik et al. | |
| 2011/0235323 | A1* | 9/2011 | Allegri | F21V 5/002 362/232 |
| 2011/0246146 | A1* | 10/2011 | Kauffman | F21K 9/00 703/2 |
| 2011/0291594 | A1 | 12/2011 | Tanaka et al. | |
| 2012/0086875 | A1* | 4/2012 | Yokota | G02F 1/133605 348/790 |
| 2012/0176792 | A1 | 7/2012 | Stolte et al. | |
| 2012/0217861 | A1 | 8/2012 | Soni | |
| 2013/0051045 | A1 | 2/2013 | Kay | |
| 2013/0265760 | A1 | 10/2013 | Demuynck et al. | |
| 2014/0307444 | A1* | 10/2014 | Gorlinskiy | F21V 5/002 362/294 |
| 2015/0204491 | A1 | 7/2015 | Yuan et al. | |

* cited by examiner

DOWNWARDLY DIRECTING SPATIAL LIGHTING SYSTEM

This application is a continuation of and claims priority to U.S. application Ser. No. 14/215,853, filed Mar. 17, 2014, which claims priority to and the benefit of U.S. Application No. 61/798,411, filed Mar. 15, 2013. The entirety of each of the foregoing applications is incorporated by reference herein.

FIELD OF DISCLOSURE

The present disclosure relates generally to lighting systems and, more particularly, to outdoor lighting systems incorporating a light diffuser to reduce glare.

BACKGROUND

The use of light emitting diode (LED) based lighting systems has become more commonplace due to their energy savings and significant lifespan. LEDs generate an intense point of light which is generally anisotropic and has a narrow incident beam. The directionality of the light emitted by the LEDs causes excessive glare which can make LEDs very bright and harsh to look at. In some cases, the glare created by LEDs temporarily impairs a person's vision, which makes the use of LEDs for parking lot lamps and street lamps problematic unless proper glare-reducing measures are taken.

An ideal design of an LED lighting system provides sufficient illumination levels on the ground while creating the effect of minimal light at the LED. To help achieve this objective, many LED manufacturers place a primary optic or lens over the semi-conductor element of the LED to create a lambertian light distribution pattern. While this light distribution pattern reduces glare to some degree, some applications, such as roadway lighting, require an even greater amount of glare reduction. In these cases, a secondary optic or lens is placed over each of the LEDs to further distribute the light. Adding the secondary optic, as opposed to modifying the primary optic itself, is preferred because the primary optic is typically installed by the manufacturer and closely integrated with the semi-conductor element of the LED.

The secondary optic typically employs a bubble refraction design that creates a batwing-shaped light distribution pattern in which light rays of greatest intensity extend from a central axis of the secondary optic at a relatively high angle. These high angle light rays, while effective at more evenly illuminating the ground surfaces beneath the luminaire, nevertheless create a significant glare for an individual approaching the luminaire.

To address the high angle brightness of the secondary optic, a tertiary optic or lens is added to diffuse the directional light emitted from the secondary optic. The diffusing characteristic of the tertiary optic disperses light over a larger surface area and thus reduces glare. Known tertiary optics are substantially curved and cover the entire array of the LEDs. As light rays pass through the curved upper ends of the tertiary optic, the light rays are diffracted in the horizontal and upward directions. This results in an undesirable light distribution if the luminaire is to be used outdoors, for example, to illuminate a parking lot or road. It is generally preferred that outdoor luminaries do not emit light in the upward direction because such light tends to exacerbate the problem of light pollution (i.e., the haze of wasted light that envelops many large cities and towns). If the luminaire is configured as a parking lot lamp or street lamp, emitting light in the horizontal direction is also undesirable because doing so may illuminate adjoining properties instead of the intended parking lot surface or road.

Another issue with known curved tertiary optics is that a local minimum or maximum of light intensity is created as the light rays pass through the curvature of the lens. This phenomenon is commonly referred to as pixilation. Pixilation casts shows that can change the look of an illuminated object and potentially create optical illusions.

A need therefore exists for a lighting system incorporating a tertiary optic that reduces glare, and additionally, minimizes light pollution and pixilation.

SUMMARY

One aspect of the present disclosure includes a luminaire that includes a plurality of LEDs disposed on a mount surface. The luminaire further includes a light diffuser spaced apart from the plurality of LEDs and including a planar surface facing the plurality of LEDs. The luminaire further includes a reflector surrounding a cavity formed between the light diffuser and the plurality of LEDs. The plurality of LEDs may emit light away from the mount surface toward the planar surface of the light diffuser, whereat a first portion of the emitted light transmits through the light diffuser and a second portion reflects off of the planar surface of the light diffuser to the reflector.

Another aspect of the present disclosure involves a method of distributing light. The method includes emitting light from a first light source towards a planar surface of a light diffuser in a first light distribution pattern such that the emitted light is directly incident upon the planar surface. Additionally, the method includes emitting light from a second light source towards the planar surface of the light diffuser in a second light distribution pattern different than the first light distribution pattern such that the emitted light is directly incident upon the planar surface. The planar surface may have a reflective material coating, such that the emitted light from the first light source and second light source that is directly incident upon the planar surface is directly incident upon the reflective material coating of the planar surface. The method additionally includes scattering a first portion of the light from the first light source and the second light source with the light diffuser, and reflecting a second portion of the light from the first light source and the second light source with the light diffuser. Still additionally, the method includes reflecting the second portion of the light from the first light source and the second light source with a first reflective surface back towards the light diffuser. Furthermore, the method includes scattering the second portion of the light from the first light source and the second light source with the light diffuser.

A further aspect of the present disclosure involves another method of distributing light. The method includes emitting light from a plurality of light sources toward a plurality of lenses, each of the light sources being aligned with a respective one of the plurality of lenses. Additionally, the method converting a first portion of the emitted light into a first light intensity distribution pattern via a first portion of the plurality of lenses, the first light intensity distribution pattern directed toward a light diffuser spaced apart from the plurality of lenses. Additionally, the method includes converting a second portion of the emitted light into a second light intensity distribution pattern via a second portion of the plurality of lenses, the light intensity distribution pattern comprising a first bundle of light rays directed toward the light diffuser and a second bundle of light rays directed toward a reflector surrounding a cavity formed between the light diffuser and the plurality of lenses. Still additionally, the method includes reflecting the light from the second bundle with the reflector, the reflected light from the second bundle reflected toward the light diffuser. Furthermore, the method includes scattering, with the light diffuser, at least a portion of each of (i) the light from the first light intensity distribution pattern, (ii) the light from the first bundle of light rays from the second light intensity distribution pattern, and (iii) the reflected light rays from the second bundle of light rays from the second light intensity distribution pattern.

BRIEF DESCRIPTION OF THE DRAWINGS

FIG. 8 is a cross-sectional view of one side of the luminaire of FIG. 1 with one of the LEDs of the inner cluster turned ON; and FIG. 9 is a cross-sectional view of one side of the luminaire of FIG. 1 with one of the LEDs of the outer cluster turned ON.

DETAILED DESCRIPTION

Figure 1:
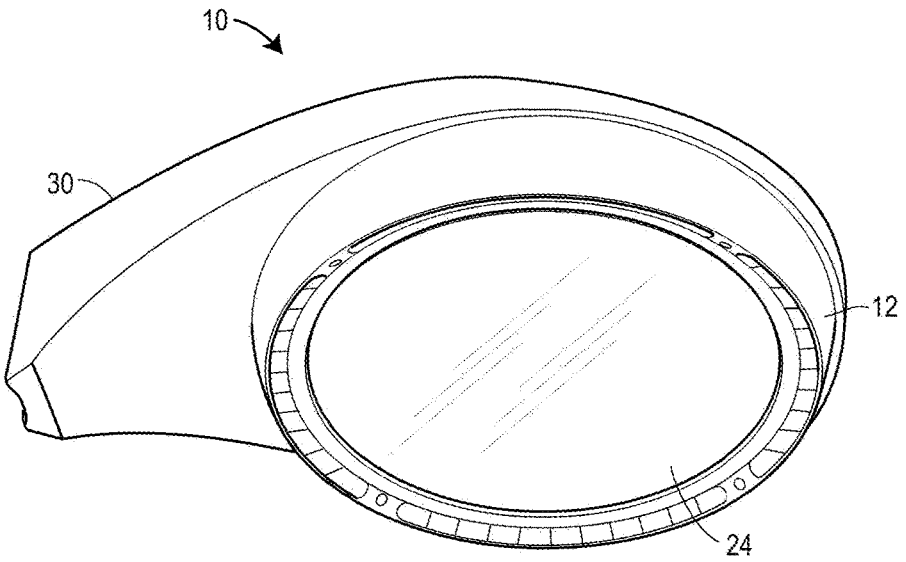
FIG. 1 is perspective view of one embodiment of a luminaire of the present disclosure.
Figure 2:
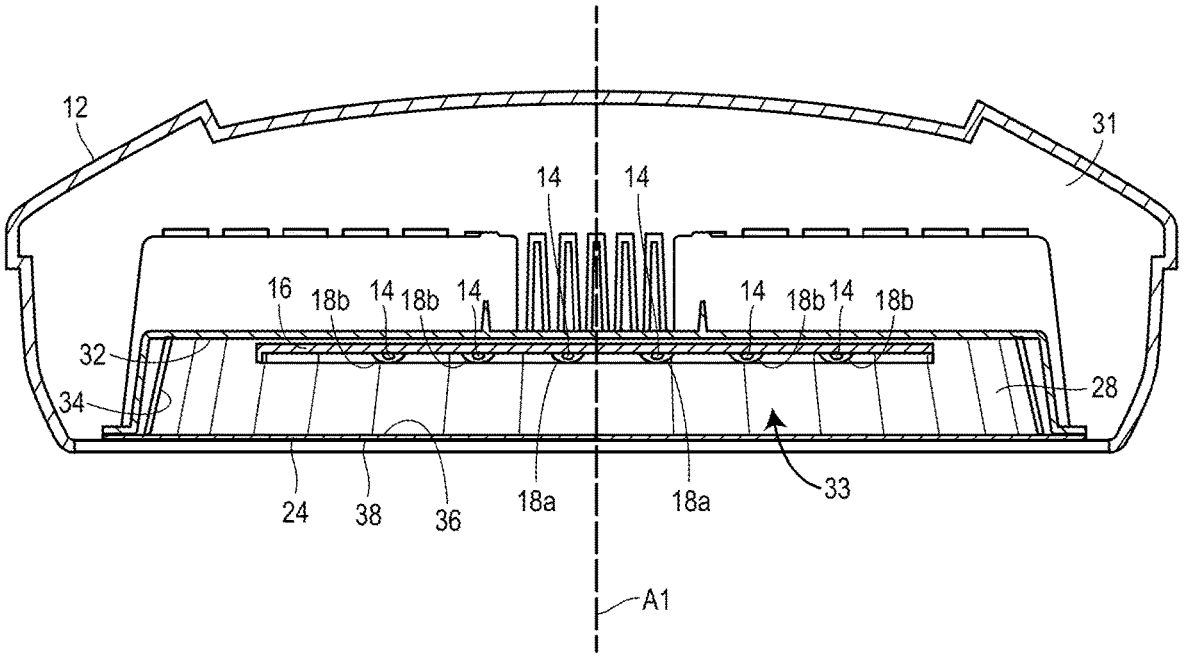
FIG. 2 depicts a cross-sectional view of the luminaire of FIG. 1.
Figure 3:
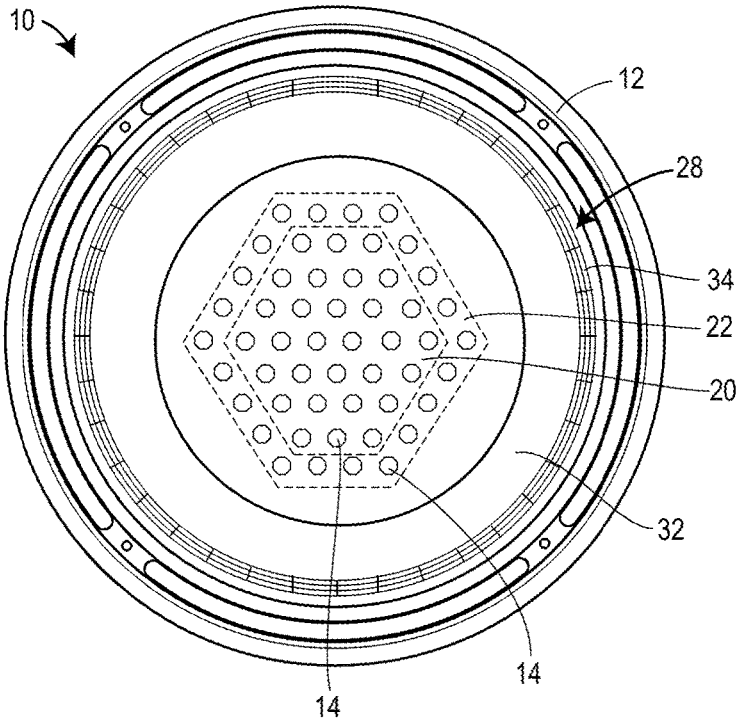
FIG. 3 is a bottom view of the luminaire of FIG. 1 with the light diffuser removed.

FIGS. 1-3 illustrate a luminaire 10 including a housing 12 enclosing a plurality of light sources, which in the present embodiment are configured as light emitting diodes (LEDs) 14. Other embodiments may use different types of light sources including, but not limited to, incandescent, fluorescent, and/or high-intensity discharge bulbs. The LEDs are arranged in an array 16 that is mounted to the interior of the housing 12. Each of the LEDs 14 is packaged with an integral primary optic or lens (not shown) that provides a lambertian light distribution. The array 16 includes a plurality of secondary optics or lenses 18*a*, 18*b*, each of which covers a respective one of the LEDs 14 and distributes light in a batwing-shaped distribution pattern. The LEDs 14 are divided into an inner cluster 20 and an outer cluster 22, with the outer cluster 22 being arranged around the periphery of the inner cluster 20. The secondary lenses 18*a*, which are aligned with the inner cluster 20 of the LEDs 14, create a light distribution pattern that differs from the secondary lenses 18*b*, which are aligned with the outer cluster 22 of the LEDs 14. After passing through the secondary lenses 18, the light rays emitted by the LEDs 14 strike a tertiary optic or lens, which in the present embodiment is configured as a light diffuser 24, which covers an open end of the housing 12. The light diffuser 24 includes a substantially planar upper surface that reflects a portion of the incident light back into the housing 12 and transmits a portion of the incident light downward toward the ground. The transmitted portion of the light is scattered or spread out by the light diffuser 24 and thereby results in the emission of relatively soft light. The reflected portion of the light bounces off a reflector 28 arranged inside the housing 12 and thereafter strikes the light diffuser 24 at a more optimal angle, causing the light to exit the luminaire 10 in a more focused and intended direction.

So configured, the luminaire 10 of the present disclosure advantageously provides sufficient illumination at the ground level while creating the effect of minimal light at the luminaire 10. The luminaire 10 thus minimizes the glare perceived by an individual looking at the luminaire 10. Additionally, the generally planar upper surface of the light diffuser 24 helps evenly distribute the light and thus reduces the effects of pixilation. In addition, the reflector 28 redirects high angle light rays at a more optimal angle so that the light rays exit the luminaire 10 in a generally downward direction. Accordingly, the luminaire 10 prevents the emission of upwardly directed light rays, which tend to cause light pollution, and also prevents light rays from exiting the sides of the luminaire 10 and illuminating objects outside an intended zone of illumination.

Each of the foregoing components of the luminaire 10 and the methods of operating the luminaire 10 will now be described in more detail.

The luminaire 10 is suitable for outdoor use, for example, as a parking lot lamp and/or a street lamp. The housing 12 may be constructed from a durable plastic and/or metal capable of withstanding weather elements such as rain, snow, ice, etc. An arm-like structure 30, which extends from the side of the housing 12, may be used to cantilever the housing from the top of a light pole (not shown). In one embodiment, the housing 12 is arranged approximately (e.g., ±10%) 15-30 feet above the ground. The housing 12 may be pivotally attached to the arm-like structure 30 so that the housing 12 can be easily opened to replace the LEDs 14 or to perform other maintenance-related tasks. As illustrated in FIG. 2, the housing 12 possesses a hollow interior 31 containing the LEDs 14, the reflector 28, mounting structures (not shown), a power source interface (not shown), and control electronics (also not shown). The light diffuser 24 extends across the open end of the housing 12 so that all light exiting the luminaire 10 passes through the light diffuser 24.

FIG. 3 depicts a bottom view of the luminaire 10 with the light diffuser 24 removed so that the array 16 of the LEDs 14 is visible. The array 16 shown in FIG. 3 includes 52 individual LEDs 14 arranged in a generally hexagonal pattern. Other embodiments can be arranged differently, for example, with a different number of LEDs arranged in circular pattern. In one preferred form, the luminaire 10 can have 96 LEDs. The outer cluster 22 of the LEDs 14 shown in FIG. 3 is formed by the radially outermost row of the LEDs. In other embodiments, the outer cluster 22 may be formed, for example, by several (e.g., 2, 3, 4, 5, 6, etc.) outer rows of the LEDs 14. The array 16 carrying the LEDs 14 is removably attached to a planar downwardly facing reflective surface 32 of the reflector 28 by screws 35 (FIGS. 8 and 9) or other suitable fasteners. The array 16 has a smaller diameter than the downwardly facing reflecting surface 32 of the reflector 28 so that a portion of the downwardly facing reflecting surface 32 of the reflector 28 is not covered by the array 16.

Referring back to FIG. 2, the reflector 28 includes a circumferential reflective surface 34 that surrounds a gap or cavity 33 formed between the LEDs 16 and the light diffuser 24. The circumferential reflective surface 34 is flat (in a cross-sectional view) and intersects the downwardly facing reflective surface 32 at a relatively abrupt angle. In other embodiments, the circumferential reflective surface 34 gradually bends into the downwardly facing reflective surface 32 such that the surfaces form a continuous parabolic or hemispherical shape, or some other curved shape. The circumferential reflective surface 34 and the downwardly facing reflective surface 32 are preferably made from metal, plastic or other material having reflective properties.

Still referring to FIG. 2, the light diffuser 24 includes an upwardly facing surface 36 spaced apart from and facing the LEDs 14. In one embodiment, the upwardly facing surface 36 is offset from the LEDs 14 by a distance of approximately (e.g., ±10%) 2-3 inches, or lesser or greater. The present embodiment of the upwardly facing surface 36 is generally planar and orthogonal to a central axis A1 of the luminaire 10. The planar aspect of the upwardly facing surface 36, coupled with the gap separating the upwardly facing surface 36 and the LEDs 14, helps prevent pixilation of the light passing through the light diffuser 24.

Many of the light rays emitted from the LEDs 14 strike the upwardly facing surface 36 of the light diffuser 24 at a substantial angle. As a result, the upwardly facing surface 36 reflects a portion of the light rays back up into the luminaire 10. In some cases, the upwardly facing surface 36 reflects approximately (e.g., ±10%) 20% of the incident light and transmits about (e.g., ±10%) 80% of the incident light. While there may be some energy losses associated with the reflection, it is generally desirable to reflect the light back up into the luminaire so that the reflector 28 can re-direct the light rays at a more optimal angle, and in a different location, so as to minimize pixilation. The reflection of high angle light rays also helps control the size of the illuminated ground area by limiting the number of light rays that exit the luminaire 10 in the horizontal, or substantially horizontal, direction.

The upwardly facing surface 36 of the light diffuser 24 can be made from a variety of semi-transparent and/or semi-reflective surfaces such as plastic (e.g., acrylic or polycarbonate) or glass. Additionally, the upwardly facing surface 36 may be coated with a material that increases its reflectivity. In some embodiments, the light diffuser 24 is made of material that does not polarize the light.

A downwardly facing surface 38 of the light diffuser 24 is textured so that it scatters the light rays exiting the light diffuser 24. The texture can be formed by a mold having a mild acid etch that is used in an injection molding process to create the light diffuser 24. The scattering effect of the downwardly facing surface 38 substantially reduces glare, and also, creates the effect of a uniformly luminous surface, which is generally considered more aesthetically pleasing than the distinct points of light created by the LEDs 14.

The angle at which the light rays initially strike the upwardly facing surface 36 of the light diffuser 24 is controlled by the shape of the secondary lenses 18*a*, 18*b*. As mentioned above, each of the secondary lenses 18*a*, 18*b* transforms the light emitted from one of the LEDs 14 into a batwing-shaped light distribution pattern. Generally speaking, a batwing-shaped light distribution pattern possesses at least one peak of light intensity arranged along a conical plane centered about a central axis of the lens. For reasons described below, the secondary lenses 18*a* associated with the inner cluster 20 of LEDs create a batwing-shaped light distribution pattern that differs from the one created by the secondary lenses 18*b* associated with the outer cluster 20 of LEDs.

Figure 4:
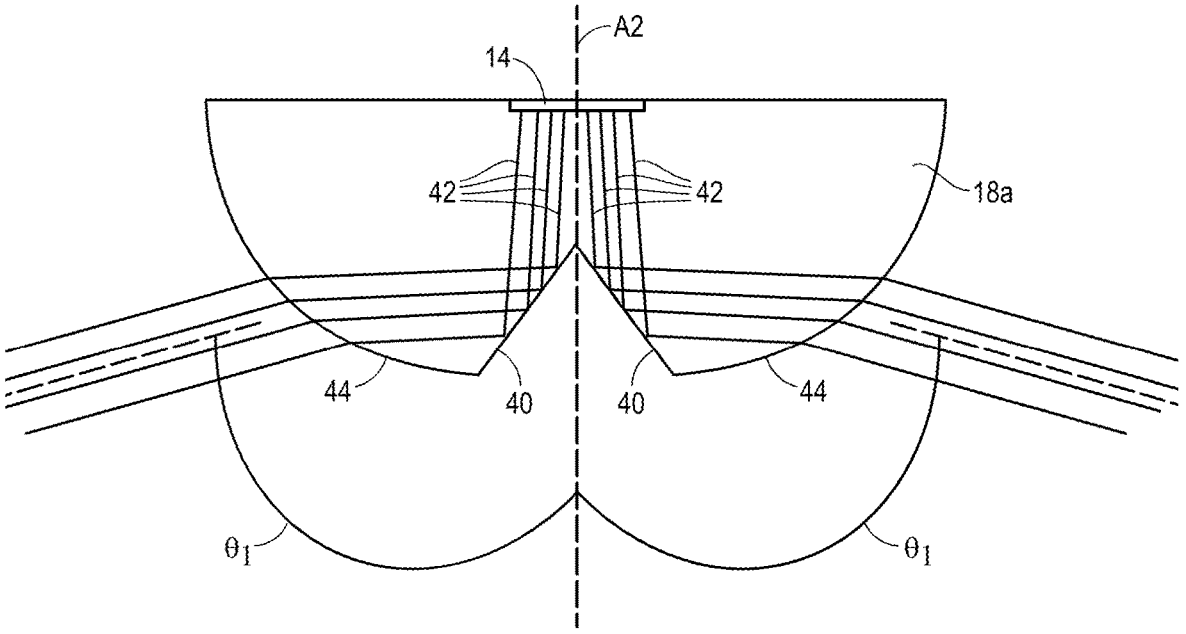
FIG. 4 illustrates a cross-sectional view of one of the plurality of secondary lenses associated with the inner cluster of LEDs.

FIG. 4 illustrates a cross-sectional view of one example of how the secondary lenses 18*a* associated with one of the LEDs 14 of the inner cluster 20 could be structured. The center of the secondary lens 18*a* includes a cone-shaped cutout having a central surface 40. A bundle of light rays 42 emitted from the LED 14 are internally reflected by the central surface 40 and thereafter strike and refract through an outer surface 44 of the secondary lens 18*a*. Each of the light rays 42 exits the secondary lens 18*a* at an angle relative to a central axis A2 of the secondary lens 18*a* measuring approximately (e.g., ±10%) 45-75 degrees, and within the range of 55-65 degrees. For the sake of simplicity, FIG. 4 depicts an angle θ1 which represents an average angle of the light rays 42 emitted from the secondary lens 18*a*. The lens depicted in FIG. 4 is merely an example, and other lenses can be used to create a similar light distribution.

Figure 5:
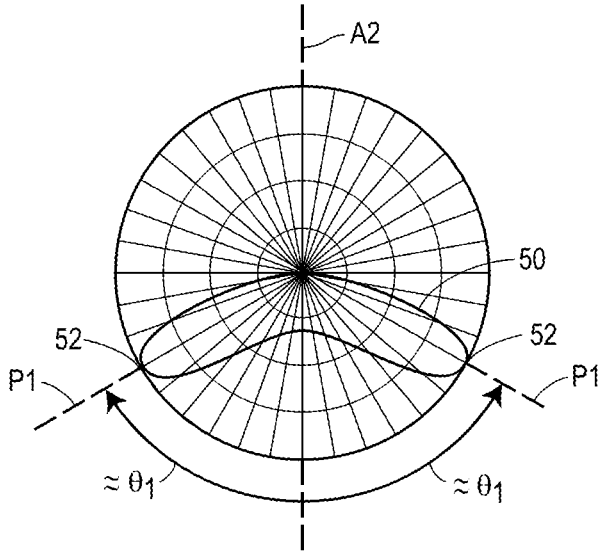
FIG. 5 is a polar distribution graph of the light distribution pattern created by the secondary lens of FIG. 4.

FIG. 5 depicts a polar distribution graph of the batwing-shaped light distribution pattern 50 created by the light emitted from the secondary lens 18*a* illustrated in FIG. 4. The batwing-shaped light distribution pattern 50, if viewed in three dimensions, would extend symmetrically around the central axis A2 of the secondary lens 18*a*. The light distribution pattern 50 has a peak of light intensity 52 arranged along an imaginary conical plane P1 centered about the central axis A2 of the secondary lens 18*a*. The angle at which the peak of light intensity 52 extends away from the central axis A2 of the secondary lens 18*a* is generally equal to the angle 81.

Figure 6:
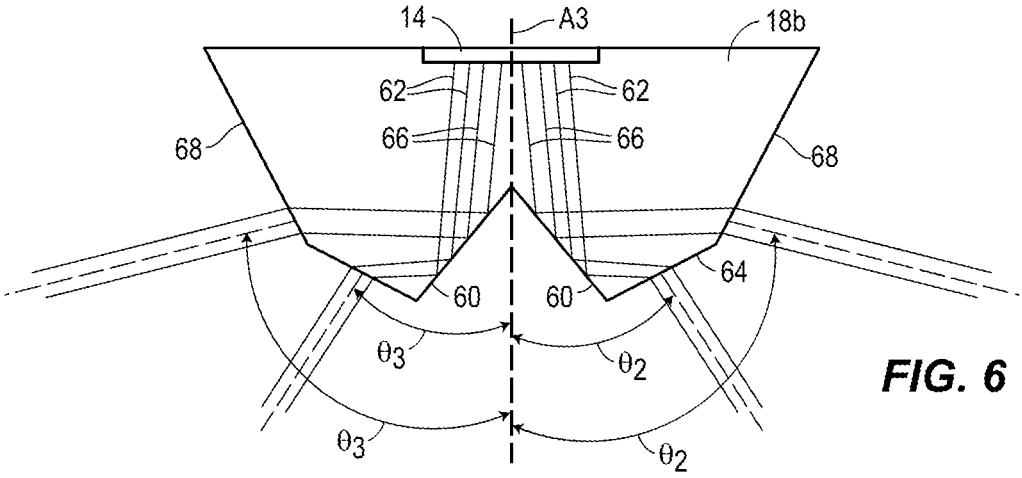
FIG. 6 is a cross-sectional view of one of the plurality of secondary lenses associated with the outer cluster of LEDs.

FIG. 6 illustrates a cross-sectional view of one example of how the secondary lenses 18*b* associated with one of the LEDs 14 of the outer cluster 22 could be structured. The center of the secondary lens 18*b* includes a cone-shaped cutout having a central surface 60. A first bundle of light rays 62 emitted from the LED 14 are internally reflected by the central surface 60 and subsequently strike and refract through a lower outer surface 64 of the secondary lens 18*b*. A second bundle of light rays 66 emitted from the LED 14 are internally reflected by the central surface 60 and thereafter strike and refract through an upper outer surface 68 of the secondary lens 18*b*. Each of the light rays 62 exiting the lower outer surface 64 forms an angle with a central axis A3 of the secondary lens 18*b* of about (e.g., ±10%) 15-45 degrees, and within the range of 30-40 degrees. Each of the light rays 66 exiting the upper outer surface 68 forms an angle with the central axis A3 of approximately (e.g., ±10%) 65-85 degrees, preferably within the range of 70-80 degrees. As such, an angle between the lower and upper outer surfaces 64, 69 can be in a range of about (e.g., ±10%) 100-155 degrees, or less or greater. For the sake of simplicity, FIG. 6 depicts an angle θ2 which represents an average angle of the light rays 62 emitted from the lower outer surface 64, and illustrates an angle 83 which represents an average angle of the light rays 66 emitted from the upper outer surface 68. In one embodiment, the central axis A3 of the secondary lens 18*b* is parallel to the central axis A2 of the secondary lens 18*a* and/or parallel to the central axis A1 of the luminaire 10. The lens of FIG. 6 is merely an example and other lenses can be used to create a similar distribution.

Figure 7:
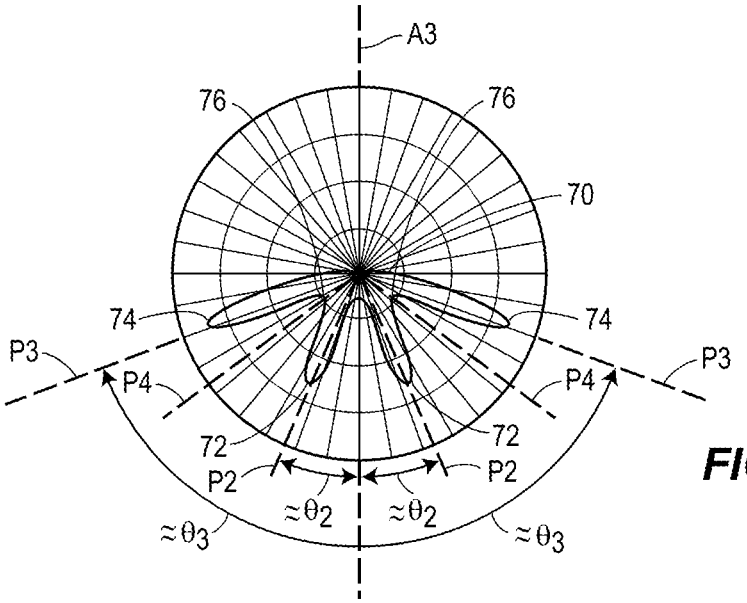
FIG. 7 is a polar distribution of the light distribution pattern created by the secondary lens of FIG. 6.

As seen in FIG. 6, a gap is formed between the first and second bundles of lights rays 62 and 66 as they exit the secondary lens 18*b*. This results in a double batwing-shaped light distribution pattern 70 shown in the polar distribution graph of FIG. 7 (which if viewed in three dimensions would extend symmetrically around the central axis A3). The light distribution pattern 70 possesses three peaks of light intensity 72, 74, 76, each of which is arranged along a respective imaginary conical plane P2, P3, P4 centered about the central axis A3 of the secondary lens 18*b*. The angle at which the first peak of light intensity 72 extends away from the central axis A3 is generally equal to the angle θ2, and the angle at which the second peak of light intensity 74 extends away from the central axis A3 is generally equal to the angle θ3. The third peak of light intensity 76 is less than both the first and second peaks of light intensity 72 and 74, and in some cases, may be equal to, or very close to, zero intensity.

As described below in more detail, the double batwing-shaped light distribution pattern 70 of the secondary lens 18*b* advantageously directs the high angle light rays (i.e., the light rays 66) directly at the circumferential reflective surface 34 of the reflector 28 instead of at the light diffuser 24. Accordingly, the high angle light rays do not first bounce off the light diffuser 24, and then strike the reflector 28, which tends to cause energy losses. Furthermore, the high angle light rays are prevented from exiting the light diffuser 24 in the horizontal direction which might otherwise occur if these light rays were to strike the outer edge of the light diffuser 24 at a shallow angle and then exit the outer edge of the light diffuser 24 in a scattered manner.

Figure 8:
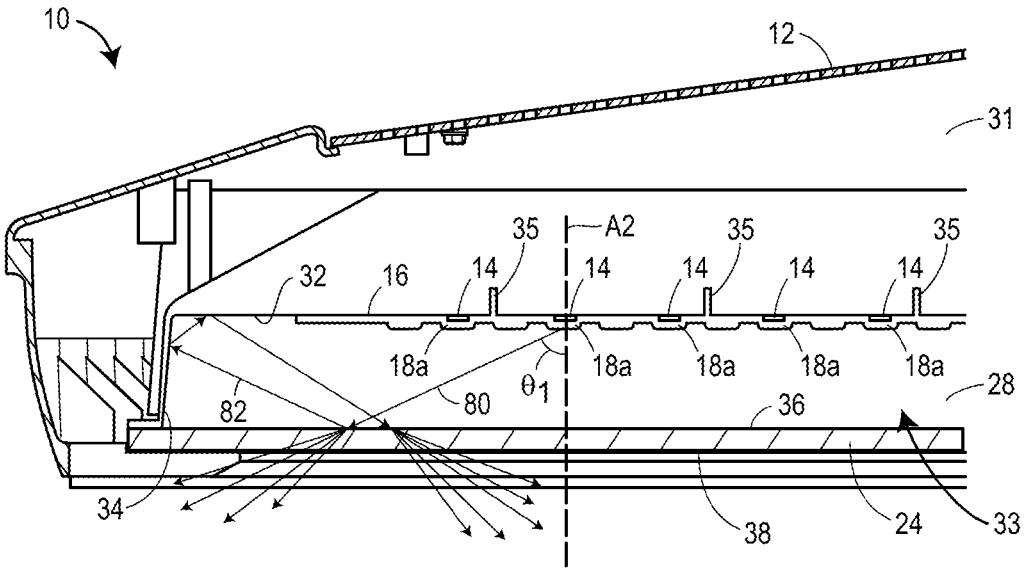
Figure 9:
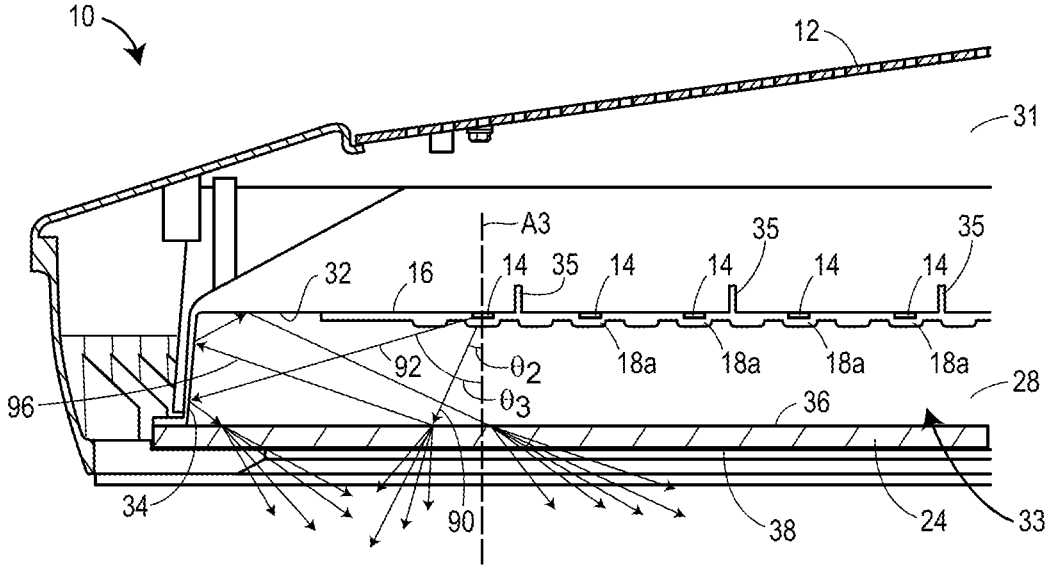

Referring to FIGS. 8 and 9, the operation of the luminaire 10 will now be described. For the sake of simplicity, FIG. 8 depicts the light emission of a single one of the LEDs 14 included in the inner cluster 20, and FIG. 9 illustrates the light emission of a single one of the LEDs 14 included in the outer cluster 22. In actuality, all of the LEDs 14 would emit light simultaneously during operation of the luminaire 10.

As illustrated in FIG. 8, the LED 14 of the inner cluster 20 emits light that first passes through a primary optic (not shown) and then passes through the secondary lens 18*a* to create an incident beam 80. The incident beam 80 includes the bundle of light rays 42 depicted in FIG. 4 and corresponds to the peak of light intensity 52 illustrated in FIG. 5. A portion of the incident beam 80 is reflected by the upwardly facing surface 36 of the light diffuser 28 and becomes reflected beam 82. The remainder of the incident beam 80 is transmitted through the light diffuser 28 and scattered by the texture of the downwardly facing surface 38 as the incident beam 80 exits the light diffuser 28. Meanwhile, the reflected beam 82 bounces off the circumferential reflective surface 34 of the reflector 28 and then reflects off of the downwardly facing reflective surface 32 of the reflector 28. The reflected beam 82 is thus redirected back at the light diffuser 28, and exits the light diffuser 28 in a generally downward direction.

FIG. 9 shows that the LED 14 of the outer cluster 22 emits light that initially passes through a primary optic (not shown) and then passes through the secondary lens 18*b* to create a first incident beam 90 and a second incident beam 92. The first incident beam 90 includes the first bundle of light rays 62 illustrated in FIG. 6 and corresponds to the first peak of light intensity 72 depicted in FIG. 7. The second incident beam 92 includes the second bundle of rays 66 illustrated in FIG. 6 and corresponds to the second peak of light intensity 74 depicted in FIG. 7. The first incident beam 90 initially strikes the upwardly facing surface 36 of the light diffuser 28, whereas the second incident beam 92 initially strikes the circumferential reflective surface 34 of the reflector 28. Little or no light is emitted from the secondary lens 18*b* in the region between the first and second incident beams 90 and 92. Accordingly, the LED 14 of the outer cluster 22 is prevented from emitting light rays that would otherwise strike the outer edge of the light diffuser 24 at a shallow angle and potentially exit the light diffuser 24, after being scattered, in a substantially horizontal direction, thereby illuminating an adjoining property.

A portion of the first incident beam 90 is reflected by the upwardly facing surface 36 of the light diffuser 28 and becomes the first reflected beam 96. Relatively speaking, only a small portion of the first incident beam 90 may be reflected by the upwardly facing surface 36 since the first incident beam 90 strikes the upwardly facing surface 36 of the light diffuser 28 at a relatively steep angle (e.g., θ2 may be within the range of 30-40 degree). The remainder of the first incident beam 90 is transmitted through the light diffuser 28 and scattered by the texture of the downwardly facing surface 38 as the first incident beam 90 exits the light diffuser 28. The first reflected beam 96 meanwhile bounces off the circumferential reflective surface 34 of the reflector 28 and then reflects off of the downwardly facing reflective surface 32 of the reflector 28. The first reflected beam 96 is thus redirected back at the light diffuser 28, and exits the light diffuser 28 in a generally downward direction.

With regard to the second incident beam 92, this beam initially reflects off the circumferential reflective surface 34 of the reflector 28 in the downward direction, and then passes through downwardly facing surface 38 of the light diffuser 24 which causes scattering of the beam. One benefit of aiming the second incident beam 92 directly at the circumferential reflective surface 34 of the reflector 28 is that the first incident beam 90 experiences a single reflection prior to exiting the luminaire, and thus is more likely to retain its original intensity. This improves the efficiency of the luminaire 10. Also, aiming the second incident beam 92 at the circumferential reflective surface 34 of the reflector 28 prevents the second incident beam 92 from passing through the outer portion of the diffuser 24 at a shallow angle, which helps prevent unintended illumination of an adjoining property next to the intended area of illumination.

While the present embodiment of the luminaire utilizes LEDs as the light sources, as mentioned above, other embodiments of the luminaire can utilize other light sources such as, e.g., incandescent bulbs, fluorescent bulbs, high-intensity discharge bulbs, etc.

The luminaire of the present disclosure advantageously reduces glare while providing a significant degree of control over the direction of the emitted light, and also, minimizing pixilation and energy losses due to internal reflections. These aspects of the luminaire make it particularly suitable for lighting outdoor areas such as a parking lot or a street, and anywhere else where light pollution is a concern. Additionally, by reducing the effects of pixilation and glare, the luminaire can sufficiently illuminate an area without impairing an individual's vision.

While the present disclosure has been described with respect to certain embodiments, it will be understood that variations may be made thereto that are still within the scope of the appended claims.

What is claimed is:

1. A luminaire comprising:

a plurality of light emitting diodes (LEDs) disposed on a mount surface;

a light diffuser spaced apart from the plurality of LEDs and including a planar surface facing the plurality of LEDs;

a reflector surrounding a cavity formed between the light diffuser and the plurality of LEDs, the plurality of LEDs emitting light away from the mount surface toward the planar surface of the light diffuser, whereat a first portion of the emitted light transmits through the light diffuser and a second portion reflects off of the planar surface of the light diffuser to the reflector;

a first plurality of lenses disposed on the mount surface, each of the first plurality of lenses having a central surface and an outer surface adjacent to the central surface being configured to convert light emitted from one of the plurality of LEDs into a first light intensity distribution pattern; and a second plurality of lenses disposed on the mount surface and arranged around a periphery of the first plurality of lenses, each of the second plurality of lenses having a central surface, a first outer surface adjacent to the central surface, and a second outer surface adjacent to the first outer surface being configured to convert light emitted from one of the plurality of LEDs into a second light intensity distribution pattern, the second light intensity distribution pattern being different from the first light intensity distribution pattern.

2. The luminaire of claim 1, wherein the first light intensity distribution pattern comprises a peak of light intensity along a conical plane centered about a central axis of a respective one of the first plurality of lenses.

3. The luminaire of claim 2, wherein the second light intensity distribution pattern comprises: (i) a first peak of light intensity along a first conical plane centered about a central axis of a respective one of the second plurality of lenses, and (ii) a second peak of light intensity along a second conical plane centered about the central axis of the respective one of the second plurality of lenses.

4. The luminaire of claim 3, wherein the second light intensity distribution pattern comprises a third peak of light intensity disposed radially between the first and second peaks of light intensity, the third peak of light intensity being less than the first peak of light intensity and less than the second peak of light intensity.

5. The luminaire of claim 4, wherein the central axis of the respective one of the first plurality of lenses and the central axis of the respective one of the second plurality of lenses are parallel to each other.

6. The luminaire of claim 1, wherein the reflector comprises: (i) a circumferential reflecting surface, and (ii) a planar reflecting surface facing the planar surface of the light diffuser.

7. A method of distributing light, the method comprising:

emitting light from a first light source towards an upwardly facing planar surface of a light diffuser in a first light intensity distribution pattern such that the emitted light is directly incident upon the upwardly facing planar surface;

emitting light from a second light source towards the upwardly facing planar surface of the light diffuser in a second light intensity distribution pattern different than the first light intensity distribution pattern such that the emitted light is directly incident upon the upwardly facing planar surface, the upwardly facing planar surface comprising a reflective material coating, such that the emitted light from the first light source and second light source that is directly incident upon the upwardly facing planar surface is directly incident upon the reflective material coating of the upwardly facing planar surface;

scattering a first portion of the light from the first light source and the second light source with the light diffuser, and reflecting a second portion of the light from the first light source and the second light source with the light diffuser;

reflecting the second portion of the light from the first light source and the second light source with a first reflective surface back towards the light diffuser;

reflecting the second portion of the light with a second reflective surface prior to reflecting the second portion of the light with the first reflective surface; and scattering the second portion of the light from the first light source and the second light source with the light diffuser.

8. The method of claim 7, wherein the first and the second light sources comprise respective pluralities of light emitting diodes (LEDs).

9. A method of distributing light, the method comprising:

emitting light from a plurality of light sources toward a plurality of lenses, each of the light sources being aligned with a respective one of the plurality of lenses;

converting a first portion of the emitted light into a first light intensity distribution pattern via a first portion of the plurality of lenses, the first light intensity distribution pattern directed toward a light diffuser spaced apart from the plurality of lenses, converting a second portion of the emitted light into a second light intensity distribution pattern via a second portion of the plurality of lenses, the second light intensity distribution pattern comprising a first bundle of light rays directed toward the light diffuser and a second bundle of light rays directed toward a reflector surrounding a cavity formed between the light diffuser and the plurality of lenses;

reflecting the second bundle of light rays with the reflector, the reflected light rays from the second bundle reflected toward the light diffuser; and scattering, with the light diffuser, at least a portion of each of (i) the light from the first light intensity distribution pattern, (ii) the light from the first bundle of light rays from the second light intensity distribution pattern, and (iii) the reflected light from the second bundle of light rays from the second light intensity distribution pattern.

10. The method of claim 9, wherein each of the plurality of light sources is mounted on a mount surface.

11. The method of claim 9, wherein each of the plurality of light sources comprises a light emitting diode (LED).

12. The method of claim 9, wherein the light diffuser comprises a planar surface facing the plurality of lenses, such that light scattered with the light diffuser is light that is (i) incident to the light diffuser at the planar surface and (ii) scattered by the light diffuser upon being incident to the light diffuser at the planar surface.

13. The method of claim 12, wherein the light diffuser further comprises a downwardly facing textured surface opposite the planar surface.

14. The method of claim 9, wherein the first light intensity distribution pattern comprises a peak of light intensity along a conical plane centered about a central axis of a respective one of the first portion of the plurality of lenses.

15. The method of claim 9, wherein the first bundle of light rays corresponds to a first peak of light intensity from the second light intensity distribution pattern, the first peak being along a first conical plane centered about a central axis of a respective one of the second portion of the plurality of lenses, and wherein the second bundle of light rays corresponds to a second peak of light intensity from the second light intensity distribution pattern, the second peak being along a second conical plane centered about the central axis of the respective one of the second portion of the plurality of lenses.

16. The method of claim 9, wherein each of the first portion of the plurality of lenses comprises a central surface and an outer surface adjacent to the central surface to convert the first portion of the emitted light into the first light intensity distribution pattern, and wherein each of the second portion of the plurality of lenses comprises a central surface, a first outer surface adjacent to the central surface, and a second outer surface adjacent to the first outer surface to convert the second portion of the emitted light into the second light intensity distribution pattern.

17. The method of claim 9, wherein the second portion of the plurality of lenses are arranged around a periphery of the first portion of the plurality of lenses.

* * * * *